United States Patent [19]

Unger et al.

[11] Patent Number: 4,558,629

[45] Date of Patent: Dec. 17, 1985

[54] HYDRAULIC CONTROL MEANS FOR PIPE THRUST-JACKING APPARATUS

[75] Inventors: Eberhart Unger, Lünen; Herbert Heitkamp, Werne, both of Fed. Rep. of Germany

[73] Assignee: Gewerkschaft Eisenhutte Westfalia, Lünen, Fed. Rep. of Germany

[21] Appl. No.: 560,078

[22] Filed: Dec. 9, 1983

[30] Foreign Application Priority Data

Dec. 10, 1982 [DE] Fed. Rep. of Germany ..... 3245728

[51] Int. Cl.[4] ..... F15B 11/05

[52] U.S. Cl. ..... 91/29; 91/6; 91/518; 91/523; 91/531; 60/486

[58] Field of Search ..... 91/6, 29, 28, 31, 32, 91/527, 531, 530, 518, 523, 521; 60/486

[56] References Cited

U.S. PATENT DOCUMENTS

| | | | |
|---|---|---|---|
| 4,046,060 | 9/1977 | Becker et al. | 91/531 |
| 4,142,445 | 3/1979 | Lohbauer | 91/523 |
| 4,210,061 | 7/1980 | Bianchetta | 91/531 |
| 4,439,063 | 3/1984 | Heitkamp | 60/486 |

FOREIGN PATENT DOCUMENTS

| | | | |
|---|---|---|---|
| 1272147 | 8/1961 | France | 91/31 |
| 1044851 | 10/1966 | United Kingdom | 91/530 |

*Primary Examiner*—Robert E. Garrett
*Assistant Examiner*—Richard S. Meyer
*Attorney, Agent, or Firm*—Sughrue, Mion, Zinn, Macpeak and Seas

[57] ABSTRACT

Pipe thrust-jacking apparatus includes a pressure ring 5 which is advanceable by a plurality of hydraulic rams 3. The rams are controlled by hydraulic control means having a plurality of hydraulic control valves 19. Each control valve is associated with a respective hydraulic ram, and is connected to a first input line and to a second input line. Each of the first input lines is connected to a respective hydraulic fluid feed line 9, and each of the second input lines 17 is connected to a common hydraulic fluid supply line 11 and to an auxiliary pump P2. The common supply line is connected to all of the feed lines. Means 12,15 are provided for selectively connecting each of the hydraulic control valves to its first input line and/or its second input line.

4 Claims, 2 Drawing Figures

HYDRAULIC CONTROL MEANS FOR PIPE THRUST-JACKING APPARATUS

BACKGROUND TO THE INVENTION

This invention relates to hydraulic control means for pipe thrust-jacking apparatus.

Pipe thrust-jacking apparatus is used for laying pipelines, particularly supply and discharge lines, in the ground. Such a pipeline is constituted by pipes made, for example, of steel or steel and concrete, and is advanced in sections from a trench. For this purpose the trench is provided with a main jacking station. Typically, such a station has up to eight hydraulic advance rams which are braced against a rear abutment, and are coupled to a pressure ring. The pressure ring acts on the rear end face of the most recently laid pipe section, and uniformly reduces and distributes the thrust forces applied by the rams to the pipeline so that strictly localised loading is avoided.

The rams are often designed as double-telescopic rams, in which case they have working strokes of considerable lengths. Difficulties arise when these rams are retracted, since the heavy pressure ring retracted therewith tends to tilt if the rams are not retracted in synchronism.

Usually, it is simply left to the skill of the operator to retract the pressure ring with the least possible tilting thereof, use being made of a relatively complicated levering technique or operating keyboard on the control platform. Not only is this manual retraction of the pressure ring very time-consuming, but faulty manoeuvring also often leads to interference with the entire pipe-advancing operation.

The aim of the invention is to provide hydraulic control means for pipe thrust-jacking apparatus which, irrespective of the skill of the operating crew, permits the pressure ring to be advanced and retracted without being tilted.

SUMMARY OF THE INVENTION

The present invention provides hydraulic control means for controlling pipe thrust-jacking apparatus of the type having a pressure ring which is advanceable by means of a plurality of hydraulic rams, the hydraulic control means having a plurality of hydraulic control valves, each of which is associated with a respective hydraulic ram, each hydraulic control valve being connected to a first input line and to a second input line, wherein each of the first input lines is connected to a respective hydraulic fluid feed line, and each of the second input lines is connected to a common hydraulic fluid supply line and to an auxiliary pump, the common supply line being connected to a plurality of the feed lines, and wherein means are provided for selectively connecting each of the hydraulic control valves to its first input line and/or its second input line.

Advantageously, the common supply line is connected to all the feed lines. Preferably, each of the feed lines is supplied with pressurised hydraulic fluid at the same rate by means of a multi-flow pump.

This hydraulic control means enables the rams to be extended or retracted in dependence upon the operating positions of the hydraulic control valves. In order to extend or retract the pressure ring, without tilting, when jacking forward of a pipeline is not occuring, the selective connection means is arranged to supply the rams with pressurised hydraulic fluid from their respective feed lines. Accordingly, each ram receives pressurised hydraulic fluid at the same, (relatively-low) flow rate, so that the rams are extended or retracted in synchronism, and the pressure ring does not tilt.

In a preferred embodiment, the selective connection means includes a second hydraulic control valve positioned in the common supply line, and a third hydraulic control valve positioned in a line leading from the auxiliary pump to the common supply line. When the rams are to be supplied with pressurised hydraulic fluid solely from their respective fluid lines, the second hydraulic control valve is arranged to block the flow of fluid from the common supply line to the first-mentioned hydraulic control valves, and the third hydraulic control valve is arranged to direct the fluid flow from the auxiliary pump to a reservoir, via a return line.

If the rams are extended in this manner until the pressure ring moves into contact with the end face of the most recently laid pipe (that is to say when the danger of tilting no longer exists), the second and third hydraulic control valves are switched over so that the second hydraulic control valve is open and the third hydraulic control valve is closed. Thus, pressurised hydraulic fluid from the common supply line and from the auxiliary pump is supplied to the first-mentioned hydraulic control valves. This high rate flow of fluid results in the rams applying a sufficient force to the pressure ring to jack the pipeline forwards.

Advantageously, the selective connection means further includes a pressure switch positioned in the common supply line upstream of the second hydraulic control valve, the pressure switch being arranged to actuate the second and third hydraulic control valves in dependence upon the pressure of the hydraulic fluid in the common supply line. Once the pressure ring contacts the end face of the most recently laid pipe, as the pressure ring is being advanced slowly by the rams supplied solely by their respective feed lines, the pressure switch senses the resulting increase in pressure in the common supply line, to open the second hydraulic control valve and close the third hydraulic control valve.

Preferably, each first-mentioned hydraulic control valve is connected to its first input line and to its second input line by a common input line, and wherein each of the first input lines and each of the second input lines is provided with a non-return valve, the non-return valves forming part of the selective connection means.

The invention also provides pipe thrust-jacking apparatus comprising a pressure ring, an abutment, a plurality of hydraulic rams acting between the pressure ring and the abutment, and hydraulic control means for controlling the pressurisation of the rams, the hydraulic control means being as defined above.

Preferably, each of the rams is a double-telescopic 5 ram.

BRIEF DESCRIPTION OF DRAWINGS

Pipe thrust-jacking apparatus incorporating hydraulic control means constructed in accordance with the invention will now be described, by way of example, with reference to the accompanying drawings, in which.

DESCRIPTION OF PREFERRED EMBODIMENT

Figure 1:
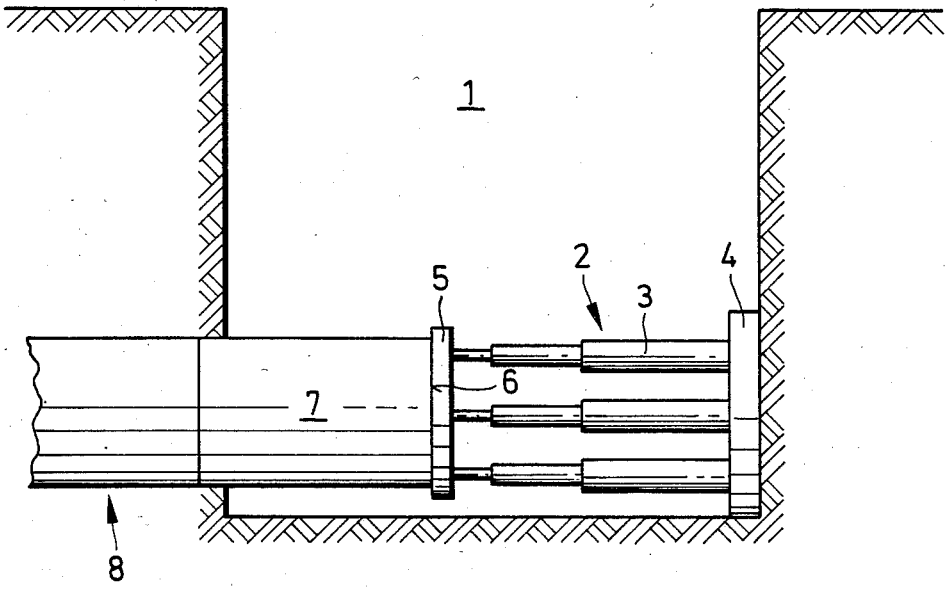
FIG. 1 is a diagrammatic side elevation of the apparatus.

Referring to the drawings, FIG. 1 shows the main jacking station 2 of the thrust-jacking apparatus, the main jacking station being positioned in a trench 1. The station 2 includes four hydraulic double-telescopic rams 3. The rams 3 are braced against a rear abutment 4, and are coupled to a pressure ring 5. The pressure ring 5 acts on the end face 6 of a pipe 7, the pipe 7 being the most recently laid pipe of a pipeline 8, in order to advance the entire pipeline. The pipe 7 is made of steel and concrete, for example.

Figure 2:
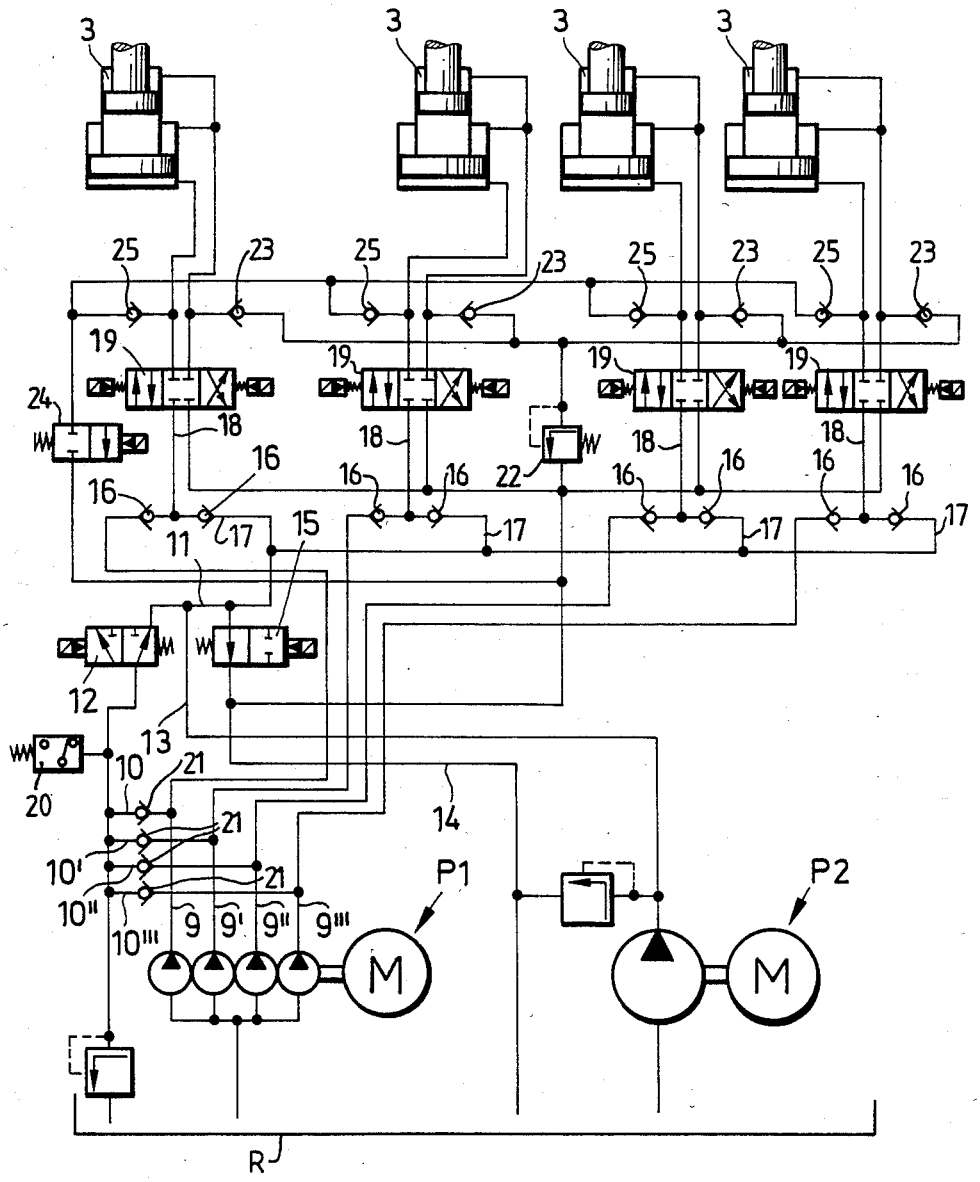
FIG. 2 is a circuit diagram showing the hydraulic control means.

FIG. 2 shows hydraulic control means for controlling the rams 3. The hydraulic control means includes a multiflow pump P1 which has separate outlets connected to hydraulic lines 9, 9', 9'' and 9'''. The lines 9, 9', 9'' and 9''' are joined to a common supply line 11, via respective connecting lines 10, 10', 10'' and 10''' and non-return valves 21. An electro-magnetically controlled hydraulic control valve 12 and a pressure switch 20 are arranged in the common supply line 11. The common supply line 11 is also connected to a further pump P2 by way of a line 13. A return line 14, which contains an electromagnetically controlled hydraulic control valve 15, connects the common supply line 11 to a hydraulic fluid reservoir R. Downstream of the valve 12, the common supply line 11 leads to respective feed lines 17. Each feed line 17 leads to a supply line 18 which is connected to one of the four rams 3 via an electro-magnetically operated multi-way hydraulic control valve 19. Each supply line 18 is also connected to a respective one of the lines 9, 9', 9'' and 9'''. Non-return valves 16 are provided in the lines 17 and in the lines 9, 9', 9'' and 9''', as shown. Pressurised hydraulic fluid can flow through each valve 19 from the associated line 17 or from the associated line 9, 9', 9'' or 9''' to the respective working chamber(s) of the associated ram 3. The valves 19 are also connected to the return line 14. The control valves 19 are used to control the extension and retraction of the rams 3. Thus, when the control valves 19 are in a first operating position, pressurised hydraulic fluid is supplied so as to extend the rams 3; and, when the control valves 19 are in a second operating position, pressurised hydraulic fluid is supplied so as to retract the rams. In a third operating position (shown in FIG. 2), the valves 19 isolate the working chambers of the rams 3 from the sources of pressurised hydraulic fluid, and from the return line 14. The return line 14 is also connected, via a pressure-relief valve 22 and non-return valves 23, with the working chambers of the rams 3 charged during retraction. A dump-valve 24 is similarly connected, via non-return valves 25, to the working chambers of the rams 3 charged during extension and to the return line 14.

The control valves 12 and 15 are used to select the flow rate of hydraulic fluid supplied to the rams 3 via the control valves 19. Thus, when the control valve 12 is closed and the control valve 15 is open, hydraulic fluid from the common supply line 11 is blocked, and hydraulic fluid flowing from the pump P2 is returned to the reservoir R via the valve 15. Consequently, the control valves 19 are supplied with hydraulic fluid, at a relatively low flow rate, from the associated individual lines 9, 9', 9'' or 9'''. This results in the rams 3 extending or retracting slowly. However, when the control valve 12 is open and the control valve 15 is closed, hydraulic fluid is supplied to the control valves 19 from both the common supply line 11 and from the pump P2. Consequently, the rams 3 are each supplied with hydraulic fluid at a higher flow rate to ensure the rams 3 extend or retract more quickly and, more particularly, in this mode the rams 3 can apply a large thrust force.

In order to extend and retract the rams 3 slowly in synchronism, the control valve 12 is closed, the control valve 15 is opened, and the control valves 19 are switched to the appropriate one of their operating positions. In this mode of operation the rams 3 are provided with the same predetermined amount of hydraulic fluid from the multi-flow pump P1 via the individual lines 9, 9', 9'' and 9'''. During operation the rams 3 can, therefore, be retracted and extended slowly without tilting the pressure ring 5.

In use, after a previous jacking step, the rams 3 are retracted slowly, with the control valves 19 in their second operating positions, with the control valve 12 closed, and with the control valve 15 open. This causes slow retraction, without tilting, of the pressure ring 5. After the rams 3 have been retracted a new pipe 7 is laid, and the control valves 19 are switched to their first operating positions, so that the rams 3 are slowly extended in synchronism. The rams 3 thus push the pressure ring 5, without tilting it, into the force-applying position. As soon as the pressure ring 5 moves into contact with the end face 6 of the pipe 7, the control valves 12 and 15 are actuated by way of the pressure switch 20 which senses increased pressure. Then, for the actual jacking operation, the rams 3 are connected to the common supply line 11 and to the pump P2, so that the rams 3 apply a high operating force to jack the entire pipeline 8 forwards.

We claim:

1. Hydraulic control means for controlling pipe thrust-jacking apparatus of the type having a pressure ring (5) which is advanceable by means of a plurality of hydraulic rams (3), said hydraulic control means comprising: a plurality of first hydraulic control valves (19), each of which is associated with a respective hydraulic ram, each first hydraulic control valve being connected to a first input line and to a second input line (17), wherein each of the first input lines is connected to a respective hydraulic fluid feed line (9–9'''), and each of the second input lines is connected to a common hydraulic fluid supply line (11) and to an auxiliary pump (P2), the common supply line being connected to all of the feed lines, wherein means (12, 15) are provided for selectively connecting each of the first hydraulic control valves to either its first input line or to both its first and second input lines, wherein each of the feed lines is supplied with pressurised hydraulic fluid at the same rate by a multi-flow main pump (P1) separate from and operable independently of the auxiliary pump, wherein each first hydraulic control valve is connected to its first input line and to its second input line by a common input line (18), wherein each of the first input lines and each of the second input lines is provided with a non-return valve (16), the non-return valves forming part of the selective connection means, and wherein the selective connection means further includes a second hydraulic control valve (12) positioned in the common supply line, whereby a pressure ring may be uniformly advanced and retracted at a relatively slow speed under no load conditions by actuating the rams with fluid from the main pump, and advanced at a relatively high speed and with increased force under load by actuating the rams with fluid from both the main and auxiliary pumps.

2. Hydraulic control means according to claim 1, wherein the selective connection means includes a third hydraulic control valve (15) positioned in a line (14) leading from the common supply line to a fluid reservoir.

3. Hydraulic control means according to claim 2, wherein the selective connection means further includes a pressure switch (20) positioned in the common supply line upstream of the second hydraulic control valve, the pressure switch being arranged to actuate the second and third hydraulic control valves in dependence upon the pressure of the hydraulic fluid in the common supply line.

4. Apparatus according to claim 1, wherein each of the rams is a double-telescopic ram.

* * * * *